United States Patent [19]

Shoemaker

[11] Patent Number: 4,600,165

[45] Date of Patent: Jul. 15, 1986

[54] TEXTILE BOBBIN

[75] Inventor: John B. Shoemaker, Lexington, N.C.

[73] Assignee: PPG Industries, Inc., Pittsburgh, Pa.

[21] Appl. No.: 553,610

[22] Filed: Nov. 21, 1983

[51] Int. Cl.[4] ..... B65H 75/14

[52] U.S. Cl. ..... 242/118.4

[58] Field of Search ..... 242/118.4, 118.41, 118.3, 242/118.31, 118.32, 118.6, 118.61, 118.1

[56] References Cited

U.S. PATENT DOCUMENTS

| | | | |
|---|---|---|---|
| 1,478,805 | 12/1923 | Tuttle | 242/118.6 |
| 2,575,131 | 11/1951 | Salkin | 242/118.6 |
| 2,651,478 | 9/1953 | Harris et al. | 242/118.6 |
| 2,690,312 | 9/1954 | Watson | 242/118.6 |
| 3,214,112 | 10/1965 | Sinquefield | 242/118.6 |
| 3,958,776 | 5/1976 | Torzo | 242/118.32 |

FOREIGN PATENT DOCUMENTS

| | | | |
|---|---|---|---|
| 1808945 | 9/1970 | Fed. Rep. of Germany | 242/118.4 |
| 1911348 | 9/1970 | Fed. Rep. of Germany | 242/118.6 |
| 2755915 | 5/1979 | Fed. Rep. of Germany | 242/118.41 |
| 1055402 | 10/1953 | France | 242/118.61 |
| 1099627 | 1/1968 | United Kingdom | 242/118.61 |
| 1286583 | 8/1972 | United Kingdom | 242/118.6 |

OTHER PUBLICATIONS

Merriman Ring Manual article, p. 10, "Winding Angles".

Saco-Lowell Twister Instruction Manual, p. 43, "Relation of Ring Diameter to Empty Bobbin Diameter for Good Running Work on Starting Up".

*Primary Examiner*—Harvey C. Hornsby
*Assistant Examiner*—Frankie L. Stinson
*Attorney, Agent, or Firm*—John E. Curley

[57] ABSTRACT

A textile bobbin is disclosed having double flanges and a strand collection zone between the flanges. The barrel of the bobbin is internally reinforced with longitudinal ribs, the upper flange is completely enclosed and the barrel and flanges are sized to provide an optimum wind angle and increased yarn capacity for high twist yarns beyond those customary in the glass fiber yarn field.

6 Claims, 5 Drawing Figures

TEXTILE BOBBIN

The present invention relates to a textile bobbin. More particularly the present invention relates to a textile bobbin utilized in winding fine glass fiber strands from forming packages on to the bobbin utilizing conventional twist frames.

BACKGROUND OF THE INVENTION

In the winding of fine textile fibers of glass strands with high twist i.e. about two turns per inch or more on bobbins in the past, it has been conventional to employ small bobbins having outside diameters on the barrel of the bobbin of between 45 and 50 mm. The bobbins typically have double flanges opposed to each other, one on the top and one on the bottom of the bobbin and between which the strands rest as the package builds on the bobbin. In general, these bobbins previously employed contain on the order of four to four and half pounds of glass yarn per bobbin.

Difficulty has been encountered in utilizing bobbins of this size due to the fact that the strands in the first few layers wound on the barrel are of inferior quality due to the sharp wind angles between the yarn and the travellers on the twist frame ring and the surface of the small diameter bobbin, typically 19.6° to 21.6°. For this reason, considerable waste is encountered because of broken filaments wound in the first several layers of glass touching the barrel of the bobbin. Thus, a need exists to increase the ability of bobbins carrying fine yarns to carry more yarn weight and to permit easy removal of all of the strands contained on the bobbin surface and to provide improved angles for removal of strands from the bobbin.

PRESENT INVENTION

In accordance with the present invention, a novel, molded bobbin is provided which has the capability of carrying quantities of glass strands far in excess of those conventionally obtained utilizing textile bobbins currently employed for fine glass fiber strands. By fine glass fiber strands it is meant glass fibers having diameters ranging from 0.00025 inches to 0.00018 inches (0.00635 mm to 0.00457 mm). The bobbin of the instant invention is characterized by having a barrel which is cylindrical in shape with spaced apart circular flanges defining the area of the barrel on which the strands are wound. One flange defines the base of the bobbin and the other flange is spaced from the base flange and from the top of the bobbin to define the winding area on the bottom barrel for the yarns to be wound. Longitudinal ribs are molded on the interior of the barrel, spaced equidistant from each other and run parallel to long axis of the bobbin from a point at or close to the bottom of the upper flange to the base the barrel. The ribs are curved downwardly and inwardly to the base of the bobbin barrel to define an upwardly sloping opening larger in diameter than the inner core formed by the longitudinal ribs of the barrel for engaging the spindles currently used in industry on conventional twist frames. The outside diameter of the bobbin barrel is typically from between 60 and 70 mm preferably, 65 to 68 mm. The flanges are circular and the width between the outer barrel surface and the outer edge of the flange is at least 32 mm, generally 33 to 40 mm and preferably 34–37 mm. The bobbin is further characterized by having the flanges reinforced with radial supports attached to the outside wall of the barrel and the inside wall of the flanges to define a series of segments around the flange areas. Each of the segments is reinforced by vertically extending support members affixed to the inside surface of the flange outer wall on the surfaces of the flanges that face each other.

In construction, the bobbin is typically molded from a suitable plastic such as styrene in two pieces with the upper flange being provided with a cover member so that the upper flange and its supports are completely enclosed by the cover member. The cover member has an upwardly extending neck portion having a lower shoulder above the flange. Above the constricted neck is an outwardly extended end portion, circular in configuration and parallel in a longitudinal plane to the circular-shaped shoulder. The shoulder and outwardly extended end portion are sized to permit similar bobbins to be nested on top thereof by inserting the top of one bobbin into the inner core of a similar bobbin to firmly engage the shoulder and end portion of the bobbin in the opening provided by the longitudinal ribs. This latter embodiment permits the stacking of the bobbins one on top of the other in cartons when they are being shipped.

DETAILED DESCRIPTION OF THE DRAWINGS

Figure 1:
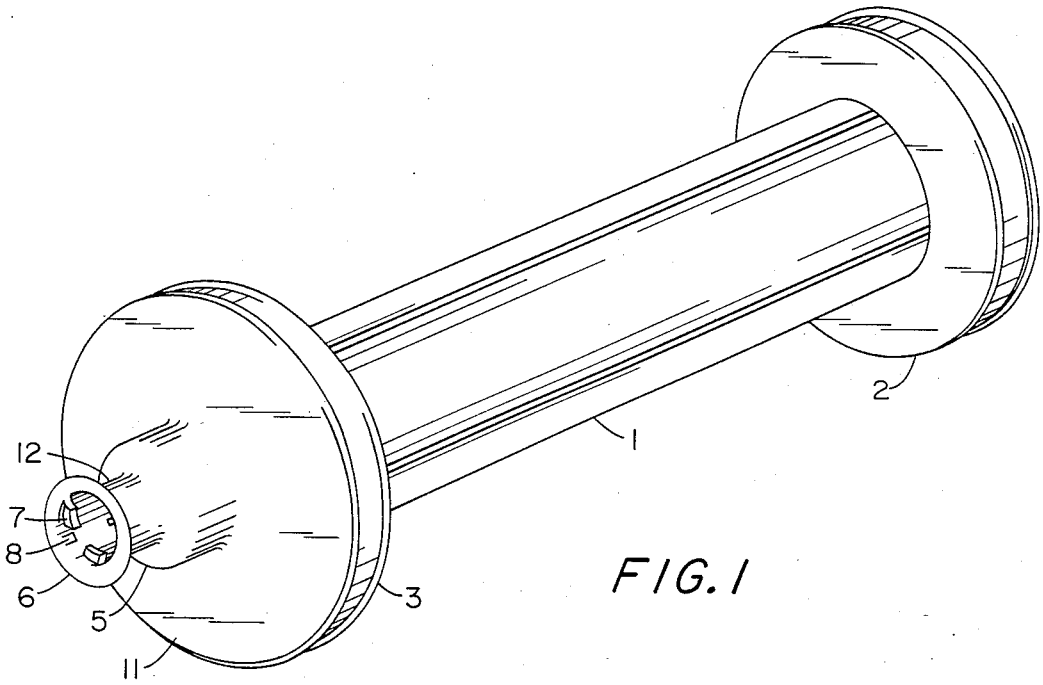
FIG. 1 is an isometric view of the bobbin of the instant invention laying on its side and resting on the flanges to show the barrel, flanges, shoulder, neck and upper portion of the bobbin top.
Figure 2:
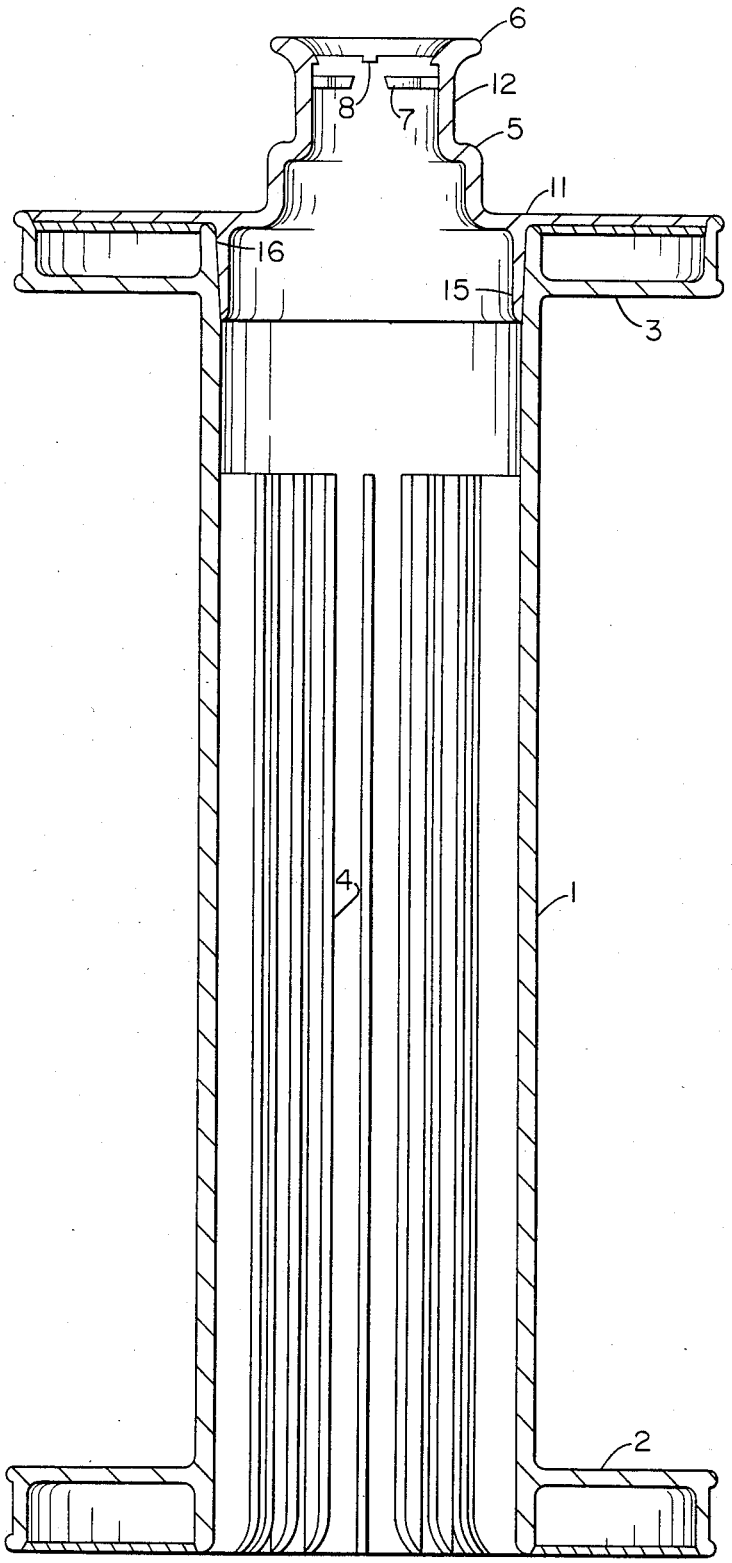
FIG. 2 is a longitudinal, side elevation of the bobbin of FIG. 1 in a cross section to show the internal ribbing of the bobbin.
Figure 3:
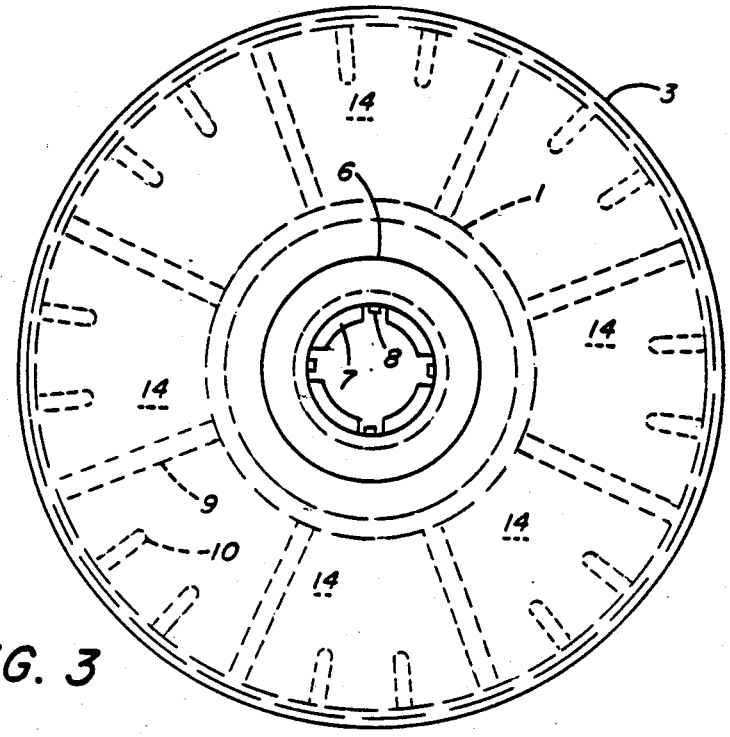
FIG. 3 is a plan view of the bobbin of FIG. 2 showing the top of the bobbin and is broken away to show the internal ribbing and vertical supports.
Figure 4:
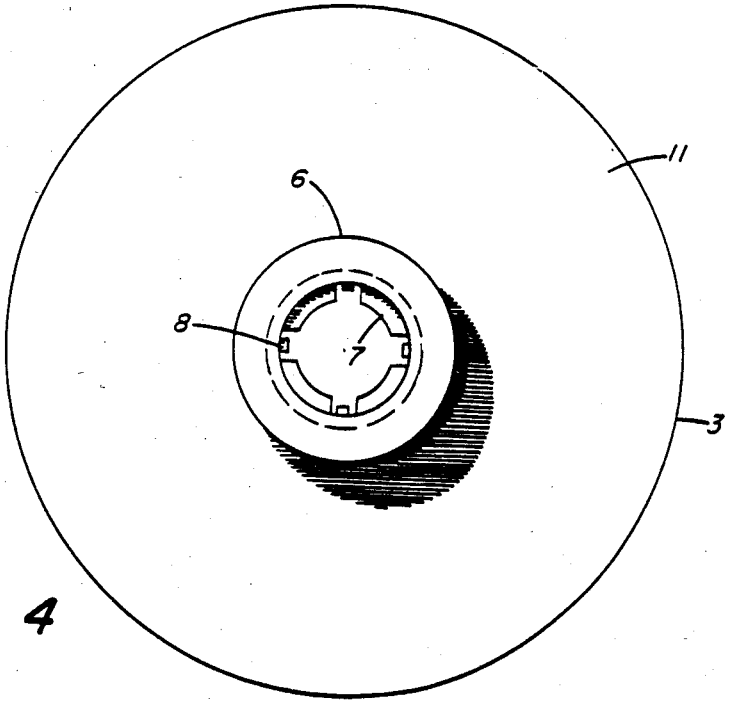
FIG. 4 is a plan view of the top of the bobbin at FIG. 2 showing the cover plate for the ribbing at the top of the bobbin.

Turning in particular to FIGS. 1 and 2, there is shown the bobbin of the instant invention which is comprised of a barrel member 1 positioned between flanges 2 and 3. The flanges are spaced from each other and the area defined by barrel 1 located between the flanges 2 and 3 is utilized to hold strand as it is wound thereon. The upper flange 3 has a cap member 11 provided with an extension or shoulder 5 positioned above a flat circumferential area used to enclose the upper flange 3. The cap member 11 has a constricted portion or neck 12 located above the shoulder 5. Above the neck 12 the cap member is extended outwardly to form a circular top member 6. Inside of the top member 6 are positioned a plurality of spaced flaps or tabs 8 which extend inwardly and downwardly around the circumference of the neck 12 on the interior surface thereof. Located below tabs 8 are a plurality of spaced arcuate shelves 7 which are positioned on the interior of neck 12 and extend inwardly at an angle generally normal to the axis of the bobbin barrel 1. On the interior of the bobbin barrel 1 are positioned a plurality of longitudinal ribs 4 which are molded into the inside wall of the barrel 1 and extend from a point at or slightly below the upper flange 3 to the base of the barrel 1. Three to four millimeters from the end of the bobbin at the bottom portion of the barrel 1 the ribs 4 are curved downwardly and inwardly and terminate at the base of the barrel.

Figure 5:
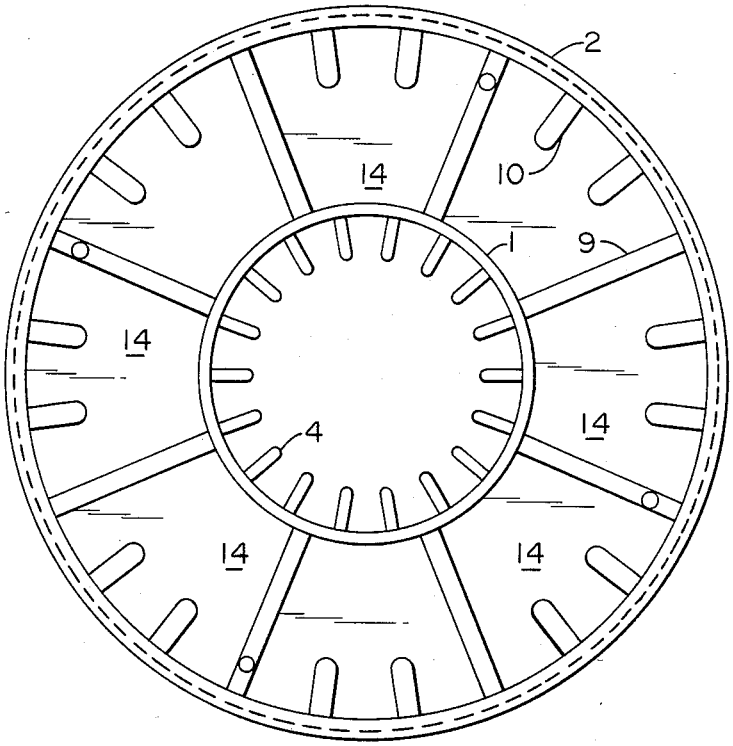
FIG. 5 is a plan view of the bottom of the bobbin of FIG. 2 showing the internal ribbing in the barrel and the spacing support members for the bottom flange, both horizontal and vertical.

In FIG. 5, the bottom flange 2 is shown and has a plurality of spaced supports 9 therein intimately molded to the inner walls of flange 2, and the outer wall of barrel 1 and to the upper inner surface of flange 2 which effectively divides the bottom flange 2 into a plurality of segments 14. Located in each of the segments 14 are vertical support members 10 which are molded to upper inner surface of flange 2, and the inner wall of flange 2. These supports 10 extend along the inner surface of the flange 2 about 10 to 13 mm and along the surface of the inner wall of flange 2 about 8 to 11 mm and are generally triangular in shape.

Turning to FIG. 13 there is shown the top portion of the bobbin, in which similarly spaced supports 9 are provided between the barrel of the bobbin and the wall of the flange 3 to form segments 14. A plurality of vertically spaced supports 10, molded to the bottom interior surface of flange 3 and the inside wall of the side of flange 3, are provided to add further support to the upper flange. The solid flat surface of the cap member 11 is provided over the supports 9 and 10 at the top of the bobbin.

As can be seen in FIG. 1 the cap member 11 contains a vertically rising neck 12 which has a shoulder 5 positioned above the solid flat surface of the cap 11 and which is as shown as being wider in diameter than the neck 12. The upper circular top member 6 is generally the same diameter as shoulder 5. The internally projecting shelves 7 on top of the bobbin are generally 3 to 4 in number and are located below the small flap members 8 which are tabs spaced equidistant around the bobbin. The shelves 7 and tabs 8 cooperate with each other to permit an identifying circular, removable cap, not shown, to be inserted therein and held between them for use in identifying the product contained on the bobbin and are conventional in the art.

The longitudinal ribs 4 running substantially over 60 to 75 percent or more of the barrel length on the interior of the bobbin provide strength to the barrel 1 of the bobbin for the weight of glass strand that will be placed on the bobbin and the forces exerted on the barrel 1 during winding. In addition ribs 4 and the circular opening they form in the interior serve as an adapter so that the bobbin can be utilized on existing twist frames which have utilized the smaller diameter bobbins. The ribs are sized to provide the same internal diameter as the prior art bobbin. The ribs being curved at the bottom provide for easy insertion of this novel bobbin onto existing spindles used to accommodate the smaller diameter of the bobbin of the prior art.

The upper cap member 11 on the top portion of the bobbin provides reduced windage during the utilization of the bobbin on a twist frame which normally use bobbins without a closed cap member and as a result strands tend to vibrate excessively during twisting.

By providing the larger barrel outside diameter, the winding angles normally encountered in winding strand on the bobbin surface from conventional twist frame rings and travellers are changed dramatically as is the circumference around which the strand is wound; providing for an increased quantity of strand in a single layer on the barrel 1. By providing flanges 2 and 3 having widths which are at least smaller than the width of the rings utilized on conventional twist frames but larger than those previously employed with the small bobbins conventional in the art, larger quantities of yarn can be wound on this bobbin. As an example, the bobbin of the prior art over which the instant invention is an improvement, typically contains four to four and one-half pounds of fiber glass strand. The bobbin of the instant invention has the capability of carrying seven or more pounds of strand on a bobbin. In addition, strand removal from the bobbin having the larger diameter has been found to be excellent unlike the previous bobbins and this is attributable to the fact that the wind angles are not as sharp typically 23° to 24°; preferably 23.4° for the initial layers of strand riding on interior of the bobbin barrel 1 during the initial packing and they can be easily removed during unwinding. This increase in wind angle also reduces the occurrences of broken filaments.

Considerable care has to be given to the dimensions utilized in order to achieve the benefits of the new improved bobbin of the instant invention and thus it is important that the outside diameter of the barrel 1 be maintained between 60 and 70 mm, with the flange area being at least 32 mm in width from the barrel 1 to the outside wall of the flange 2 and 3. Preferably the outside diameter of the barrel 1 is between 65 and 68 mm and the widths from the barrel 1 to the edges of flanges 2 and 3 is preferably between 34 and 37 mm. In the most preferred embodiment the outside diameter of the barrel is 65.48 mm and the flange width from barrel to edge is 36.5 mm. The reinforcing of the flanges 2 and 3 is important since this bobbin is utilized to carry greater weights of yarn than has heretofore been possible. In the preferred embodiment, eight segments 14 are provided in each of flanges 2 and 3 with horizontal divider members 9 running between the interior wall of the flange and the outside of the bobbin barrel. The vertical supports 10 located in each of the segments 14 are preferably two in number though more than two can be employed if desired. The vertical supports 10 in the top flange 3 preferable terminate slightly below the edge of the bobbin flange 3 so that cap member 11 will seat firmly on them.

In the bobbin as shown in FIG. 2 the bobbin barrel 1 is sloped slightly inwardly internally at the top portion of the barrel 1 to form a circular downwardly sloping opening 16. The cover member 11 is provided with a depending ring 15 molded into to it so it can mate snugly in the circumferential downwardly sloping opening 16 formed by the slight sloping of the bobbin barrel 1 at the top. When the cap 11 is placed in the barrel 1, it is held in place by applying an appropriate material such as methyl ethyl ketone to the opening 16 and the outer surface of ring 15 which mates therewith. This provides a firm seat for the top portion of the bobbin and does not permit the cap member 11 to be removed after assembly.

The shoulder member 5 and the cooperating top 6 act in conjunction with flat surface of the cap 11 to permit nesting of these bobbins one on top of the other, so that they can be shipped in cartons one above the other in rows. The internal ribs 4 of the instant bobbin are preferably 12 to 24 in number, the most preferable arrangement being, 18 ribs, which are positioned at 20 degree intervals around the circumference of the inner surface of barrel 1. The ribs 4 are preferably 8 to 9 mm in depth as measured from the interior wall of the bobbin to their free ends. The barrel 1 has a preferred thickness of 4 to 5 mm and the ribs 4 are generally 2.5 to 3.5 mm in thickness. The ribs 4 preferably extend from the bottom of the barrel 1 upwardly to a point somewhere between 75 and 85 percent of the total length of the barrel 1. This has been found to provide adequate rib support for the barrel 1 and an opening on the interior of the bobbin suitable for good engagement of the interior of barrel 1 with existing spindles. It also provides adequate strength to the wall of the barrel 1 during the winding operation and subsequent handling.

While the invention has been described with reference to certain specific embodiments it is not intended to be limited thereby except insofar as appears in the accompanying claims.

I claim:

1. A textile bobbin comprising a hollow, cylindrical, elongated tube, spaced apart top and bottom circular flanges on said tube, the bottom flange having a flat solid surface facing the bobbin tube surface, and a solid circular side wall, the flat surface and the side wall of the bottom flange being reinforced with radial and vertical ribs attached thereto, said top flange having a flat solid bottom surface facing the tube and a solid circular side wall which, with the bobbin tube forms a circular recess in said top flange, said circular side wall and flat solid surface being reinforced in said recess with radial and vertical ribs attached to their respective surfaces, the tube surface between the flat solid surfaces of said flanges defining the wind area for yarn placed on the bobbin, longitudinal ribs on the interior of said hollow elongated tube, spaced equidistant from each other and running parallel to the long axis of the bobbin tube from a point on the inside of the tube below the bottom of the top flange to the base of the tube and defining an opening suitable for engagement of the ribs with a spindle, said ribs being curved downwardly and inwardly toward the inner tube wall to define an upwardly sloping opening larger in diameter than the inner core formed by the longitudinal ribs, a cover member for the top flange having a flat solid surface coextensive with the area of the top flange and adapted to cover the recess in said top flange and engage the radial ribs thereof, the bobbin tube and circular side wall of said top flange to thereby completely enclose said recess, a circular, hollow, inwardly tapered plug depending downwardly from the cover member and integrally molded therewith and adapted to engage the bobbin tube at the top thereof, said bobbin tube having an outwardly tapered upper section on the interior thereof adapted to receive said plug, a shoulder, neck and collar on said cover member and extending vertically and integrally molded therewith to thereby form the bobbin top, said bobbin tube having an outside diameter between 60 millimeters and 70 millimeters and the flanges at the top and bottom having a width between the outer surface of said bobbin tube and the outside edge of each of said flange of at least 32 millimeters.

2. The bobbin of claim 1 wherein the bobbin tube has an outside diameter of 65 to 68 mm and the width of the flanges from the barrel to the flange edge being 33 to 40 mm.

3. The bobbin of claim 2, wherein the said shoulder, neck and collar on said cover member are sized in length and diameter to permit a similar bobbin to be nested on the top thereof by inserting said collar, neck and shoulder into the inner core of a similar bobbin formed from the longitudinal ribs thereof.

4. The bobbin of claim 1 wherein the bobbin tube has an outside diameter of 65.48 mm and the width of the flange from the barrel to the flange edge is 36.51 mm.

5. The bobbin of claim 4, wherein the said shoulder, neck and collar on said cover member are sized in length and diameter to permit a similar bobbin to be nested on the top thereof by inserting said collar, neck and shoulder into the inner core of a similar bobbin formed from the longitudinal ribs thereof.

6. The bobbin of claim 1, wherein the said shoulder, neck and collar on said cover member are sized in length and diameter to permit a similar bobbin to be nested on the top thereof by inserting said collar, neck and shoulder into the inner core of a similar bobbin formed from the longitudinal ribs thereof.

* * * * *

UNITED STATES PATENT AND TRADEMARK OFFICE

CERTIFICATE OF CORRECTION

PATENT NO. : 4,600,165

DATED : July 15, 1986

INVENTOR(S) : John B. Shoemaker

It is certified that error appears in the above-identified patent and that said Letters Patent is hereby corrected as shown below: Title page:

The following references were cited by the Examiner and should be added to the References Cited section under U.S. PATENT DOCUMENTS:

| | | | |
|---|---|---|---|
| 3,860,194 | 1/1975 | Roscher | 242/118.32 |
| 3,675,871 | 7/1972 | Heyden | 242/118.3 |
| 3,408,023 | 10/1968 | Alexander et al. | 242/118.61x |

Signed and Sealed this

Thirteenth Day of January, 1987

*Attest:*

DONALD J. QUIGG

*Attesting Officer*

*Commissioner of Patents and Trademarks*